US008971750B2

(12) United States Patent
Uezono

(10) Patent No.: US 8,971,750 B2
(45) Date of Patent: Mar. 3, 2015

(54) IMAGE FORMING APPARATUS FOR DISCHARGING ELECTRIC CHARGE CHARGED TO A CAPACITOR AND DISCHARGE DEVICE FOR DISCHARGING ELECTRIC CHARGE CHARGED TO A CAPACITOR

(75) Inventor: Takaomi Uezono, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 207 days.

(21) Appl. No.: 13/494,748

(22) Filed: Jun. 12, 2012

(65) Prior Publication Data

US 2012/0321337 A1 Dec. 20, 2012

(30) Foreign Application Priority Data

Jun. 14, 2011 (JP) ..... 2011-132533

(51) Int. Cl.
*G03G 15/00* (2006.01)

(52) U.S. Cl.
CPC ..... *G03G 15/80* (2013.01)
USPC ..... 399/88

(58) Field of Classification Search
USPC ..... 399/88, 89, 90, 11, 37, 72
See application file for complete search history.

(56) References Cited

U.S. PATENT DOCUMENTS

2011/0085815 A1* 4/2011 Kishi et al. ..... 399/69

FOREIGN PATENT DOCUMENTS

JP 7-333751 A 12/1995

* cited by examiner

*Primary Examiner* — Billy Lactaoen
(74) *Attorney, Agent, or Firm* — Canon USA Inc. IP Division

(57) ABSTRACT

An apparatus includes a CPU, wherein, when the apparatus is currently in a power OFF state, and if an operation different from that of a power source switch is performed, the CPU connects a load to a power source by the switch to discharge a capacitor.

10 Claims, 13 Drawing Sheets

IMAGE FORMING APPARATUS FOR DISCHARGING ELECTRIC CHARGE CHARGED TO A CAPACITOR AND DISCHARGE DEVICE FOR DISCHARGING ELECTRIC CHARGE CHARGED TO A CAPACITOR

BACKGROUND OF THE INVENTION

1. Field of the Invention

The present invention relates to an apparatus that controls capacitor discharge.

2. Description of the Related Art

In an image forming apparatus as an example of an apparatus including a substrate equipped with a capacitor, when the substrate is inserted or withdrawn for the purpose of maintenance, the substrate to be inserted or withdrawn needs to be prevented from being destroyed due to a hot swap caused by electric charge charged to the capacitor. To this end, some methods are discussed relating to the discharge of the capacitor.

For example, Japanese Patent Application Laid-Open No. 61-032400 discusses a flash lamp for emitting light by discharge of electric charge charged to a capacitor, a power-off detection circuit for detecting that a power source is turned off, and a power source for the flash lamp that causes the capacitor to forcibly discharge when the power-off state is detected.

Japanese Patent Application Laid-Open No. 07-333751 discusses an image forming apparatus including a protective cover and an emergency discharge circuit including a switch for detecting an installed condition of the protective cover, wherein, when removal of the cover is detected, electric charge stored in the capacitor is discharged.

Recently, power-saving has been promoted more and more. For example, a printer that performs a standby operation with a standby power of 1.0 W is discussed. The printer capable of performing the standby operation with such low power consumption is provided with an all-all-night power source. The all-night power source is provided, for example, for detecting an access to the printer from the external device even when a power source of the apparatus main body is set to an OFF state by a user operation. Accordingly, the power source of the printer can be automatically returned from the OFF state at any time the user desires to use the printer.

The all-night power source is described below in more detail. The all-night power source is normally equipped with a capacitor in order to generate a smoothed power source output and performs the above described standby operation while continuously charging the capacitor (i.e., while storing electric charge to the capacitor). For example, in a case where the image forming apparatus is placed in the standby state with low power consumption such as 1.0 W, it is desirable that the power to be consumed in charging the capacitor is minimized as much as possible. In this regard, to minimize discharge of the capacitor as much as possible, a measure for interrupting the discharge path is provided in the circuit. This is because, if a large current is discharged, the circuit operates to charge the corresponding amount of current, resulting in inviting an increase of the standby power.

As described above, not only the low power consumption of the printer in the standby operation but also improved usability, e.g., automatic return of the printer from the standby operation, has been also required lately. To the contrary, in the method that the electric charge of the capacitor is automatically and immediately discharged as it is discussed in Japanese Patent Application Laid-Open No. 61-032400 and Japanese Patent Application Laid-Open No. 07-333751, easier maintenance can be realized but the improved usability cannot be realized to a satisfactory level.

On the other hand, as described above, when the substrate is inserted or withdrawn for the purpose of maintenance, to prevent the substrate to be inserted or withdrawn from being destroyed due to the hot swap caused by the electric charge charged to the capacitor, it is necessary to discharge the capacitor. However, in the printer equipped with the all-night power source including the above described capacitor, the electric charge of the capacitor cannot be discharged immediately and automatically. Therefore, a service person is forced to wait for completion of the discharge of the electric charge of the capacitor for a long time.

A solution for the above issue can be found in providing the printer with a circuit that can detect disconnection of a power source cable from an alternating current (AC) inlet and can change the capacitor to automatic discharge of the electric charge. However, the above solution requires a new automatic detection circuit for detecting the disconnection of the power source cable from the AC inlet. As a result thereof, the solution invites an increased cost. For example, while the printer is in a standby state with the standby power of 1.0 W, it is necessary to operate the automatic detection circuit using a zero crossing detection. Accordingly, an operation power to be used in a photocoupler or the like increases. Alternatively, in order to save data in a case of power outage or power shutoff, a configuration can be assumed that reads and writes a memory by using the electric charge charged to the capacitor. However, in the case of the above assumption, if the electric charge of the capacitor is discharged immediately in a manner as discussed in Japanese Patent Application Laid-Open No. 61-032400 and Japanese Patent Application Laid-Open No. 07-333751, a possible problem is created in an operation of the printer.

Such a problem is created not only for the image forming apparatus as described in the above example but is commonly created to all the apparatus equipped with the capacitor.

SUMMARY OF THE INVENTION

The present invention is directed to an apparatus capable of reducing power consumption and of swiftly performing discharge of a capacitor while saving a cost thereof.

According to an aspect of the present invention, an image forming apparatus includes a power source configured to convert an input alternating current (AC) voltage to output thus converted voltage, a capacitor configured to be connected to somewhere between an output of the power source and a ground to smoothen the output voltage from the power source, an operating unit configured to instruct an operation different from an ON and OFF operation of the power source, a switch configured to switch a state between a state that the power source is connected to a load and a state that the power source is disconnected from the load, and a control unit configured to detect an operation of the operating unit, wherein a power supply state to the image forming apparatus can be switched between a first power supply state in which power is supplied to the load and to the control unit and a second power supply state in which power consumption is less than that in the first power supply state, the power source is disconnected from the load by the switch to stop supplying power to the load, power is supplied to the switch, and power is supplied to the control unit, and wherein, when the image forming apparatus operates in the first power supply state, if the operation is detected by the control unit, an operation according to the detected operation is performed and, when the image forming apparatus operates in the second power supply state, if the operation is detected by the control unit, the power source is brought into connection with the load via the switch so as to increase a discharge current of the capacitor.

According to another aspect of the present invention, a discharge device that is connected to somewhere between an output of a power source that converts an input alternating current (AC) voltage and outputs thus converted voltage and a ground and is configured to discharge a capacitor for smoothing an output from the power source includes an operating unit configured to instruct an operation different from an ON and OFF operation of the power source, a switch configured to switch a state between a state that the power source is connected to a load and a state that the power source is disconnected from the load, and a control unit configured to detect an operation of the operating unit, wherein a power supply state to the discharge device can be switched between a first power supply state in which power is supplied to the load and to the control unit and a second power supply state in which power consumption is less than that in the first power supply state, the power source is disconnected from the load by the switch to stop supplying power to the load, power is supplied to the switch, and power is supplied to the control unit, and wherein, when the discharge device operates in the first power supply state, if the operation is detected by the control unit, an operation according to the detected operation is performed and, when the discharge device operates in the second power supply state, if the operation is detected by the control unit, the power source is brought into connection with the load via the switch so as to increase a discharge current of the capacitor. According to another aspect of the present invention, an image forming apparatus includes a power source configured to convert an input alternating current (AC) voltage to output thus converted voltage, a capacitor configured to smoothen the output voltage from the power source, an operating unit configured to instruct an operation of the image forming apparatus, a switch configured to switch a state between a state that the power source is connected to a load and a state that the power source is disconnected from the load, and a control unit configured to detect an operation of the operating unit, wherein a power supply state to the image forming apparatus can be switched between a first power supply state in which power is supplied to the load and to the control unit and a second power supply state in which power consumption is less than that in the first power supply state, the power source is disconnected from the load by the switch to stop supplying power to the load and power is supplied to the control unit, and wherein, when the image forming apparatus operates in the first power supply state, if the operation is detected by the control unit, an operation according to the detected operation is performed and, when the image forming apparatus operates in the second power supply state, if the operation is detected by the control unit, the power source is brought into connection with the load via the switch. According to another aspect of the present invention, A discharge device that is configured to discharge a capacitor for smoothing an output from the power source, the discharge device includes a switch configured to switch a state between a state that the power source is connected to a load and a state that the power source is disconnected from the load, a detecting unit configured to detect an operation of an apparatus that is connected to the power source, wherein a power supply state to the discharge device can be switched between a first power supply state in which power is supplied to the load and to the detecting unit and a second power supply state in which power consumption is less than that in the first power supply state, the power source is disconnected from the load by the switch to stop supplying power to the load and power is supplied to the control unit, and wherein, when the discharge device operates in the first power supply state, if the operation is detected by the control unit, an operation according to the detected operation is performed and, when the discharge device operates in the second power supply state, if the operation is detected by the control unit, the power source is brought into connection with the load via the switch.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
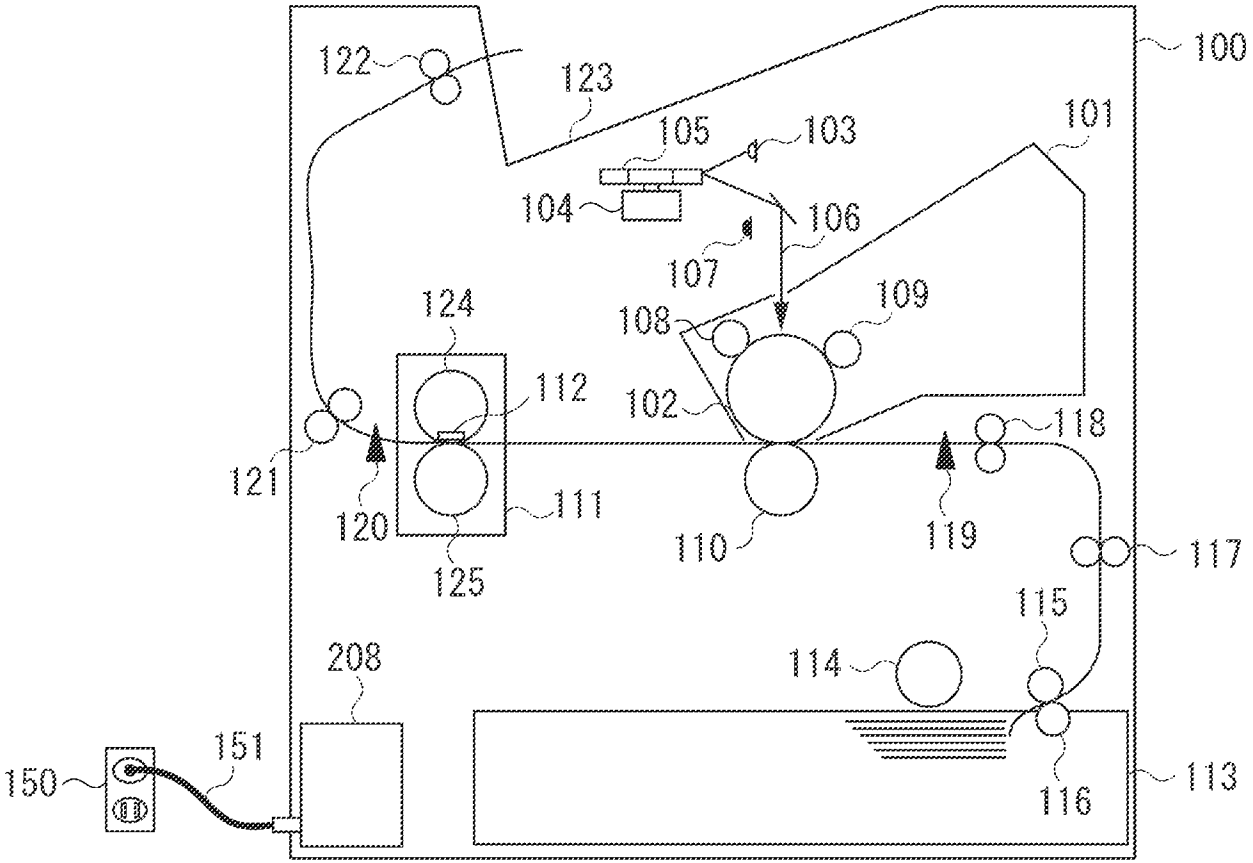
FIG. 1 is a schematic diagram illustrating a cross sectional configuration of an image forming apparatus.

FIG. 1 is a schematic diagram illustrating an entire configuration of an image forming apparatus according to a first exemplary embodiment of the present invention. FIG. 1 illustrates a main body of an image forming apparatus 100. A toner cartridge 101 is detachably mounted to the image forming apparatus 100. A photosensitive member 102 is an image bearing member. A semiconductor laser 103 is a light source. A polygonal mirror 105 is rotated by a scanner motor 104. In an optical path of the laser beam 106, a light beam emitted from the semiconductor laser 103 is polarized by the polygonal mirror 105 to scan over the photosensitive member 102. A light receiving sensor 107 receives the light beam polarized by the polygonal mirror 105. A charging roller 108 uniformly charges over the photosensitive member 102. A developing roller 109 develops an electrostatic latent image formed on the photosensitive member 102 with a toner. A transfer roller 110 transfers a toner image developed by the developing roller 109 to a predetermined recording sheet.

A fixing device 111 includes a fixing heater 112 for heat-fusing the toner transferred to the recording sheet, and a fixing film 124 and a pressure roller 125, which fix the toner on the recording sheet thereto by applying heat and pressure while conveying the recording sheet. A sheet cassette 113 stores sheets. A sheet feed roller 114 feeds out a sheet from the sheet cassette 113 with a single rotation to a conveyance path. A feeding roller 115 and a retard roller 116 are paired to separate sheets piece by piece in a case where the sheet feed roller 114 picks up a bundle of sheets. The feeding roller 115 and the retard roller 116 subsequently feed out the sheets separately to the conveyance path. An intermediate roller pair 117 conveys the sheet fed from the sheet cassette 113 to the image forming unit. A pre-transferring roller pair 118 sends thus conveyed sheet to the photosensitive member 102.

A top sensor 119 synchronizes writing (i.e., recording/printing) an image to the photosensitive member 102 with a sheet conveyance with respect to the fed sheet as well as measures a length of the fed sheet in a sheet conveyance direction. A fixing sensor 120 detects presence or absence of the sheet after the toner image is fixed thereto. A conveyance roller pair 121 discharges the sheet after fixation to a paper discharge conveyance path. A discharge roller pair 122 discharges the sheet to a discharge tray 123 on which discharged sheets are stacked. A commercial power supply (i.e., commercial alternating power supply) 150 outputs an alternating current (AC) voltage. A power unit 208 connected to the commercial power supply (i.e., commercial alternating power supply) 150 via a power source cable 151 converts the AC voltage into almost direct current (DC) voltage and supplies power to be consumed by the above described image forming operation at the converted voltage to each unit of the apparatus.

Figure 2:
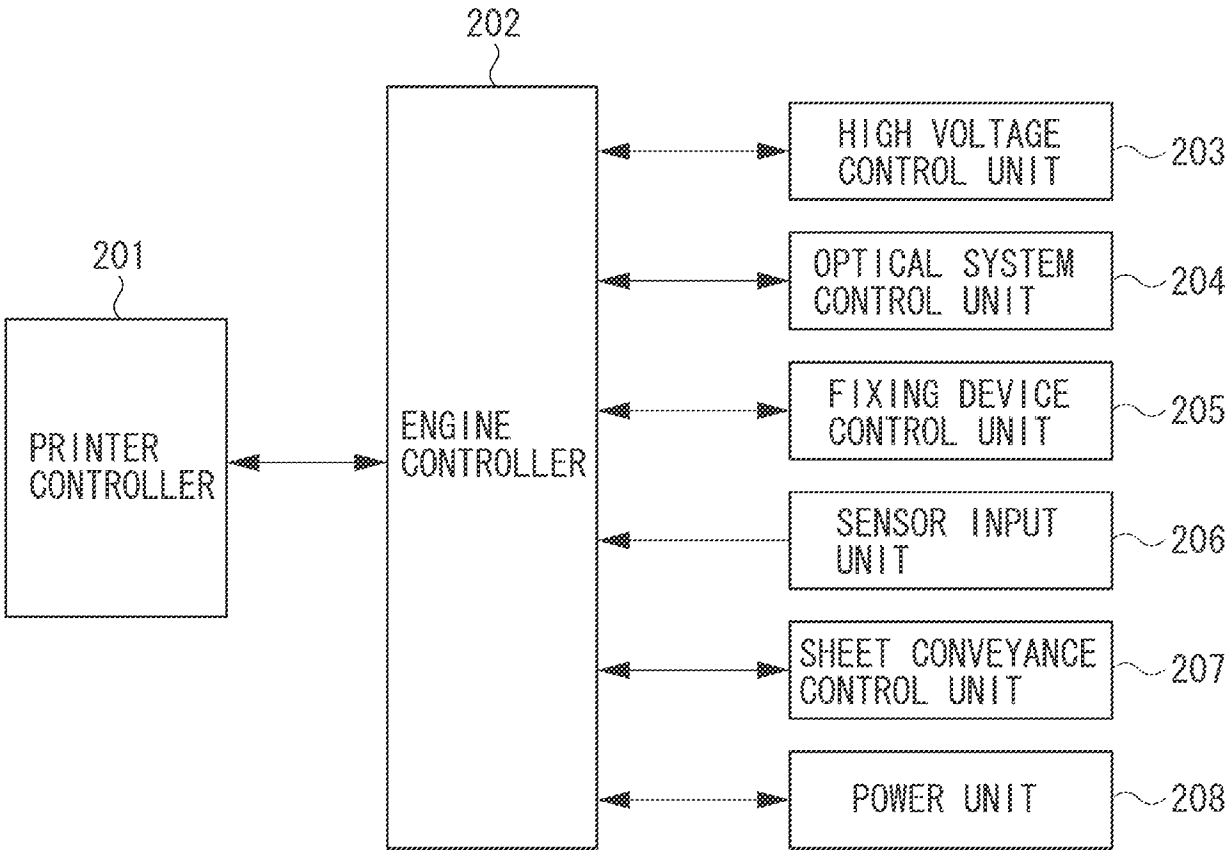
FIG. 2 is a block diagram illustrating a circuit configuration in the image forming apparatus.

FIG. 2 is a block diagram illustrating a circuit configuration in the image forming apparatus 100. In FIG. 2, a printer controller 201 renders image code data transmitted from an external device such as a host computer (not illustrated) to bit data necessary for printing of the printer as well as reads out printer internal information to display it. An engine controller 202 controls a printing operation of each unit of the printer engine according to an instruction of the printer controller 201 as well as informs the printer internal information to the printer controller 201. The engine controller 202 includes a central processing unit (CPU) and an application specific integrated (ASIC) circuit.

A high voltage control unit 203 performs high voltage output control with respect to each of the charge, the development, the transfer, and the like according to an instruction of the engine controller 202. An optical system control unit 204 controls driving and stopping of the scanner motor 104 and lighting of the laser beam according to an instruction of the engine controller 202. A fixing device control unit 205 performs driving and stopping of energization to the fixing heater 112 according to an instruction of the engine controller 202. A sensor input unit 206 notifies the engine controller 202 of detection results of the light receiving sensor 107, the top sensor 119, the fixing sensor 120, and the like.

A sheet conveyance control unit 207 performs driving and stopping of the motors, rollers, and the like for conveying the recording sheet according to an instruction of the engine controller 202. The sheet conveyance control unit 207 controls driving and stopping of each of the sheet feed roller 114, the pair of the feed roller 115 and the retard roller 116, the pre-transferring roller pair 118, the photosensitive member 102, the fixing film 124, the pressure roller 125, the conveyance roller pair 121, and the discharge roller pair 122. A power unit 208 supplies power to the engine controller 202, the printer controller 201, and each control unit.

The power unit 208 generates a DC voltage when the power source cable 151 is connected to the power unit 208 to input an alternating current (AC). The power unit 208 is equipped with an all-night power source that continues a power supply of a second power of a supply amount smaller than that of a first power, so that an automatic return operation can be performed even in a case where a power OFF operation of the printer is performed by a user. The power OFF here does not mean a state that the power supply is completely interrupted but means a state that a minimum power supply required for the automatic return to a power ON state can be made.

The power ON is a state that more power is supplied than the power supplied in a power OFF state and corresponds to a state where print data is received from an external device to be ready to form an image. The power ON state corresponds to a print standby state. In the power ON state, power is also supplied to the engine controller 202 and the printer controller 201. Further, in the power ON state, an operating clock frequency of the CPU 306 is set higher than that in the power OFF state.

The printer controller 201 has such a configuration that an operator who works on maintenance can easily detach the printer controller 201 for the purpose of an improved workability. The operator disconnects the power source cable 151, then attaches or detaches the printer controller 201.

Figure 3:
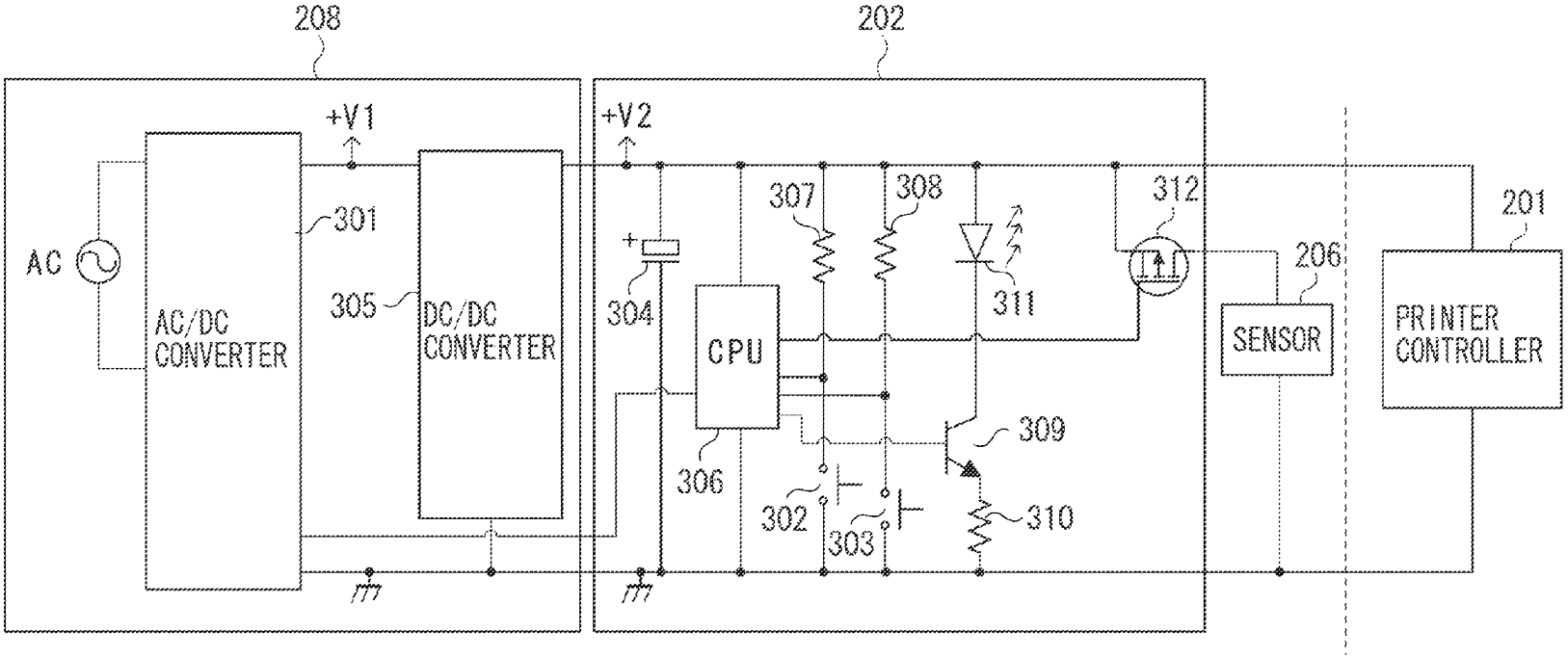
FIG. 3 illustrates a circuit configuration of a power unit.

FIG. 3 illustrates a circuit configuration of the engine controller 202, the printer controller 201, and the power unit 208 in the image forming apparatus 100. The engine controller 202 includes the CPU 306.

When AC is input into the power unit 208, an alternate current (AC)/direct current (DC) converter 301 converts an AC current to a DC current and generates a DC voltage (i.e., voltage after conversion). Although it is not illustrated in FIG. 3, a capacitor is provided in the AC/DC converter 301 for smoothing an output voltage. Thus generated DC voltage is divided by a voltage divided resistance (not illustrated) and fedback to control the divided voltage to be a predetermined voltage.

The CPU 306 can switch the output voltage according to switching of the voltage divided resistance. The voltage divided resistance outputs a voltage +V1 (i.e., voltage after conversion) in a case of the voltage divided resistance 1, whereas outputs a voltage +V2 (i.e., voltage after conversion) in a case of the voltage divided resistance 2. A relationship between the voltage +V1 and the voltage +V2 is +V1>+V2. The voltage +V1 input from the AC/DC converter 301 is also supplied to a laser drive substrate (not illustrated) provided with the semiconductor laser 103 via a V1 supply load switch (not illustrated) in addition to the DC/DC converter 305.

The DC/DC converter 305 is a step-down type DC/DC converter which outputs the voltage +V2 when the voltage +V1 is input. The voltage +V2 generated by the DC/DC converter 305 is supplied to the engine controller 202 and the printer controller 201. The CPU 306, the capacitor 304, current-limiting resistors 307, 308, and 310, a switch (SW) 302 for performing a test print, and a SW 303 for allowing the user to switch the printer state between the power ON state and the power OFF state are connected to the voltage +V2 within the engine controller 202, respectively.

Also, a light-emitting diode (LED) 311 (i.e., display unit visible from the outside of a device as a load) which emits light when the printer is in the power ON state in order to inform that the printer is in the power ON state is also connected to the voltage +V2 within the engine controller 202. A transistor (Tr) 309 (i.e., switching unit), which is a drive transistor, for changing a connection state between the LED 311 and the power source, in other words, for turning ON (i.e., a state that the power source is connected to the load) and OFF (i.e., a state that the power source is disconnected from the load) the LED 311 is also connected to the voltage +V2 within the engine controller 202. Here, the capacitor 304 is connected to somewhere between the DC/DC converter 305 and a ground to take a roll of smoothing an output voltage output from the DC/DC converter 305. An output voltage after being smoothen is supplied to the apparatus main body.

A field effect transistor (FET) 312 (i.e., switching unit) is a load switch for turning ON (i.e., a state that the power source is connected to the load) and OFF (i.e., a state that the power source is disconnected from the load) the power supply from the voltage +V2 to a sensor 206 (i.e., load). The sensor 206 includes a plurality of sensors such as photo-interrupters. The sensor 206 consumes power constantly while it is supplied with power. The voltage +V2 supplies power to other units (not illustrated) via a V2 supply load switch (not illustrated). The V1 supply load switch and the V2 supply load switch are switched between ON and OFF according to an instruction from the CPU 306.

The SW 302 and SW 303 are momentary switches. Pressing of the switch allows the electrodes within the switch to contact with each other to establish conduction therebetween. Release of the pressing of the switch allows the electrodes within the switch to disconnect from each other to keep a non-conduction state therebetween. The CPU 306 operates in a state that the CPU 306 can detect a pressed state of each momentary switch in both of a power ON state and a power OFF state. In other words, the CPU 306 is supplied with power so as to be able to operate in both of the power ON state and the power OFF state.

A printer controller 201 is configured such that a substrate can be detached from the printer by unscrewing a substrate fixing screw (not illustrated) arranged on a surface of the printer. The SW 302 is a switch (SW) for performing a test print through which a printing operation is confirmed during maintenance of the printer. The SW 302 corresponds to an operating unit for performing an operation other than an ON/OFF operation of the power source. Normally, the operating unit corresponding to the SW 302 is installed inside an outer cover of a back surface of the printer so as not to allow the user to operate it. A dedicated hole is provided in the outer cover of the back surface at a position facing to the SW 302. The service person can press the SW 302 with a dedicated tool without removing the outer cover of the printer.

The printer controller 201 has a function for detecting an access (e.g., input of a print job) from an external device such as a host computer in the power OFF state of the apparatus main body. The printer controller 201 notifies the CPU 306 that an access from the external device is detected. The CPU 306 operates so as to be detectable of the notification indicating the access from the external device even in the power OFF state.

When the power source cable 151 is connected and an AC input is started, the printer is brought into the power OFF state. In the power OFF state of the printer, the CPU 306 comes into a low power consumption mode in which an operating clock frequency of the CPU 306 is lowered as well as the LED 311 is turned off. In addition, to minimize the power consumption, the FET 312 is turned OFF by the CPU 306, so that the power supply to the sensor 206 is turned OFF. The CPU 306 causes the V1 supply load switch and the V2 supply load switch to turn OFF and the power supply to the other units (not illustrated) is turned OFF. The voltage divided resistance of the AC/DC converter 301 is switched to the voltage divided resistance 2 by the CPU 306 and an output voltage of the AC/DC converter 301 comes to be the voltage +V2.

The DC/DC converter 305 performs feedback such that the output voltage becomes the voltage +V2. Therefore, when the voltage +V2 equivalent to the output voltage is input, current to be used in the feedback becomes smaller and thus only little current is consumed.

When an operation button corresponding to the SW 303 is pressed, the printer becomes the power ON state from the power OFF state. In the power ON state, the CPU 306 returns to a normal operating clock frequency to cause the LED 311 (i.e., load) to light up. According to an instruction from the CPU 306, the voltage divided resistance of the AC/DC converter 301 is switched to the voltage divided resistance 1 and an output voltage of the AC/DC converter 301 becomes the voltage +V1. The CPU 306 starts supplying power to the sensor 206 by turning the FET 312 ON as well as starts supplying power to the other units by turning the V1 supply load switch and the V2 supply load switch ON. When the SW 302 is pressed in the power ON state, the CPU 306 starts the print operation to print a test print image. The test print here is performed for the purpose that the service person confirms whether the printer can normally form a toner image by, for example, forming a black vertical line over an entire page of an A4 size sheet. As a matter of course, what is formed in the test print is changed according to a purpose of use thereof. The test print is not limited to what is exemplified here.

Figure 4:
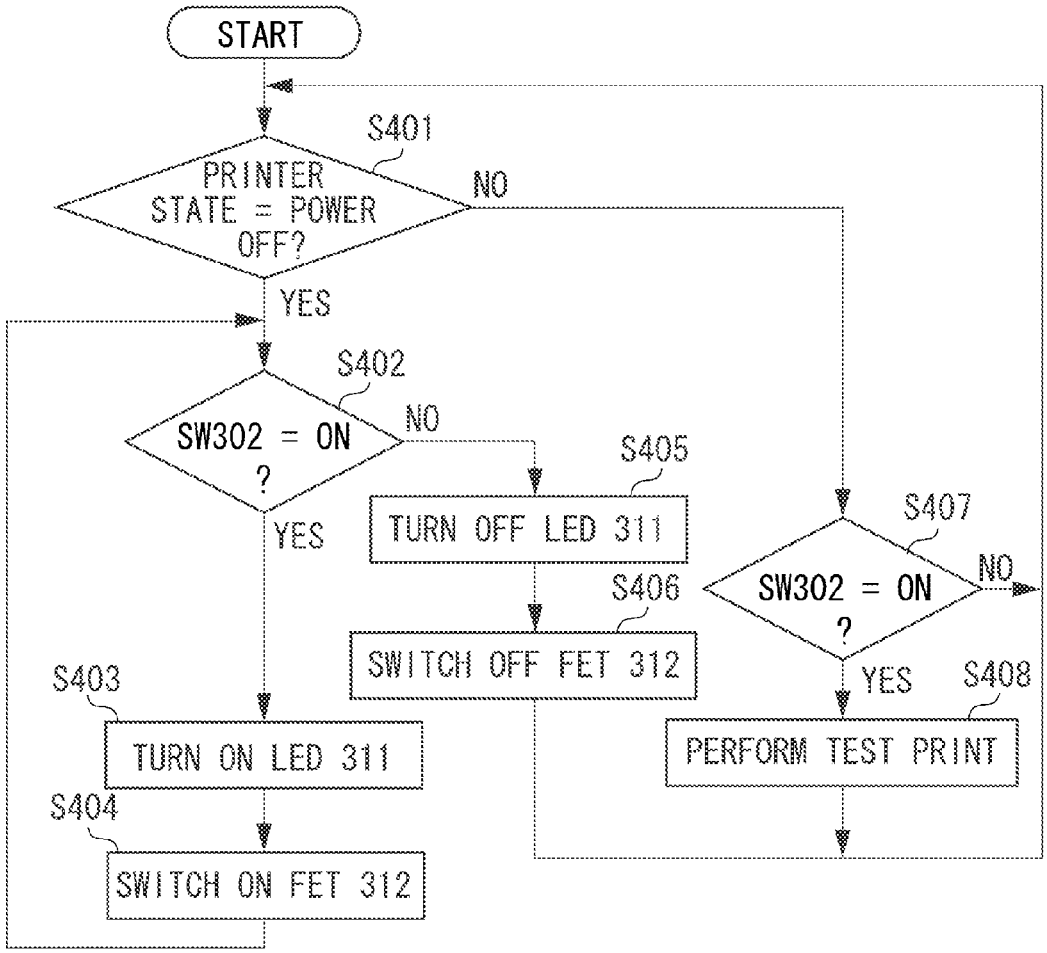
FIG. 4 is a flow chart illustrating control of capacitor discharge.

FIG. 4 is a flow chart illustrating control of the capacitor discharge in the present exemplary embodiment. The flow chart in FIG. 4 is performed during a print standby state. At the time, power required in forming a toner image is not supplied to the members directly related to a toner image formation, e.g., the fixing device 111. A load connected to the power source in the flow chart of FIG. 4 is a load to which power is supplied also during the print standby state.

In step S401, the CPU 306 determines whether the printer is currently in the power ON state or in the power OFF state. If the printer is in the power ON state (i.e., in a first power supply state), as described above, power is supplied at least to the CPU 306 that detects states of pressing the SW 303 and the SW 302. In other words, the CPU 306 functions as a detection unit for detecting an operation input to the operating unit. Power is supplied also at least to the sensor 206 and the LED 311 as loads other than the CPU 306. Power may be supplied also to a laser drive substrate (not illustrated).

If the printer is in the power OFF state (i.e., in a second power supply state), power to the loads, e.g., the sensor 206 and the LED 311, to which power is supplied in the power ON state is interrupted. In other words, a connection between the loads and the power source is interrupted by a switch, e.g., the FET 312. Further in the power OFF state, power is supplied only to the CPU 306, which detects an operation to the operating unit, an operation of switch ON or OFF of the power source, and an access from an external device, and the switching units. As a matter of course, power consumed in the power OFF state is less than power consumed in the power ON state.

If the CPU 306 determines that the printer is in the power ON state (NO in step S401), then in step S407, the CPU 306 detects whether the SW 302 (i.e., operating unit) is turned ON.

If the CPU 306 detects that the SW 302 is turned ON (YES in step S407), then in step S408, the CPU 306 controls the image forming unit to print a test print image in response to the pressing of the SW 302. Then, the processing returns to step S401. If the SW 302 is not pressed, namely is OFF, (NO in step S407), the processing returns to step S401.

In step S401, if the CPU 306 determines that the printer is in the power OFF state (YES in step S401), then in step S402, the CPU 306 detects whether the SW 302 is turned ON. If the CPU 306 detects that the SW 302 is turned ON (YES in step S402), in step S403, the CPU 306 turns the Tr 309 (i.e., switching unit) ON to cause the LED 311 (i.e., load) to light up.

In step S404, the CPU 306 turns the FET 312 (i.e., switching unit) ON to connect the sensor 206 (i.e., load). A time period during which the Tr 309 and the FET 321 are continuously kept ON is equal to or more than a time period during which at least the discharge of the capacitor 304 is completed under a condition that the AC input voltage from the commercial power supply (i.e., commercial alternating power supply) 150 is interrupted.

On the other hand, if the CPU 306 detects that the SW 302 is OFF (NO in step S402), then in step S405, the CPU 306 turns the Tr 309 (i.e., switching unit) OFF to bring the LED 311 (i.e., load) into disconnection with the power source. The CPU 306 causes the LED 311 (i.e., load) to be turned off, thereby disconnecting the LED 311 from the power source. In step S406, the CPU 306 turns the FET 312 (i.e., switching unit) OFF to cut off the connection between the sensor 206 and the power source. Then, the processing returns to step S401. If the CPU 306 detects that the SW 302 is OFF (NO in step S402) and the LED 311 has already been turned off and the FET 312 is OFF, the state is maintained as it is. Then, the processing returns to step S401.

Figure 5:
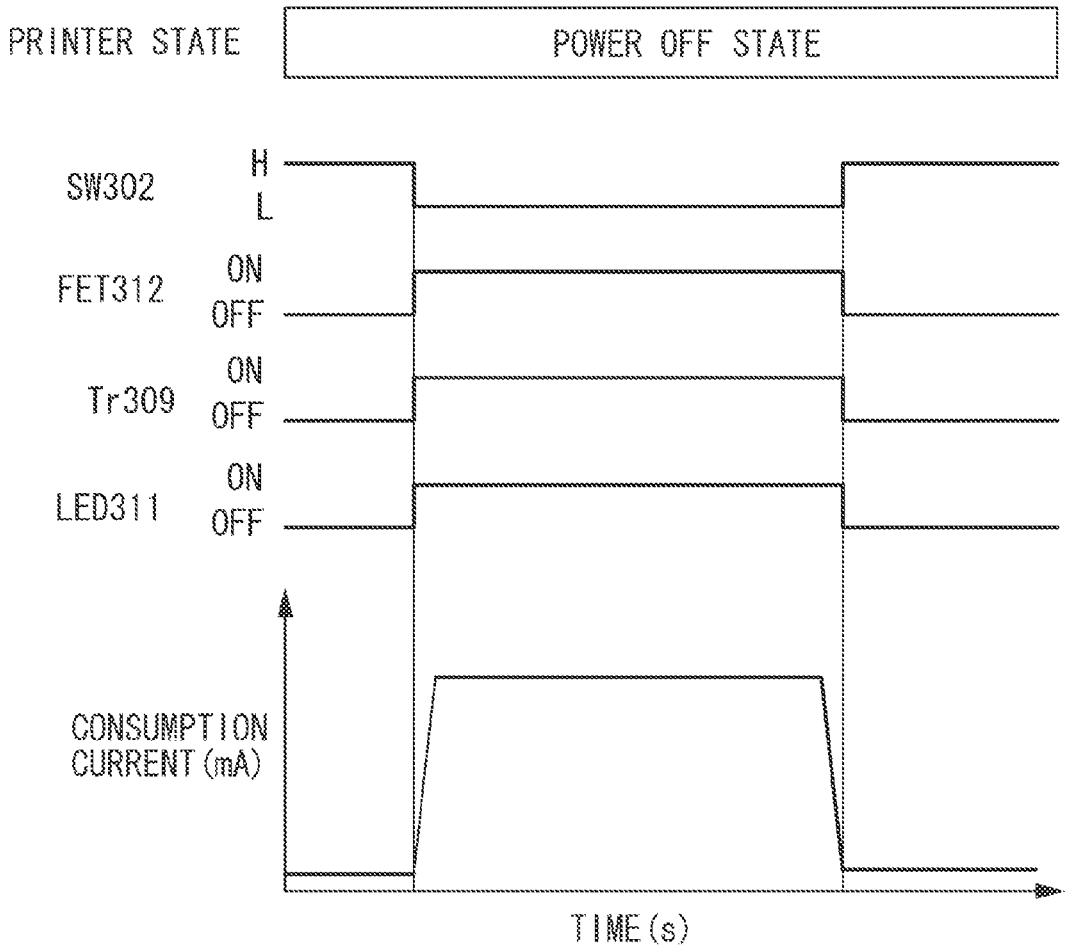
FIG. 5 is a timing chart in the control of the capacitor discharge.

A description is made as to the control of the capacitor discharge in the present exemplary embodiment. FIG. 5 illustrates a timing chart in the control of the capacitor discharge. FIG. 5 corresponds also to the flow chart in FIG. 4.

When the CPU 306 detects that the SW 302 is pressed and thus an input signal from the SW 302 changes from High level to Low level, the CPU 306 turns the FET 312 (i.e., switching unit) ON. The CPU 306 also turns the Tr 309 (i.e., switching unit) ON to cause the LED 311 to light up. The sensor 206 (i.e., load) connected via the FET 312 consumes a predetermined amount of current while the sensor 206 is supplied with power. The LED 311 (i.e., load) also consumes current. Consequently, while the SW 302 is kept pressed, an amount of current to be consumed can be increased by an amount of current consumed by the sensor 206 and the LED 311.

Figure 6A:
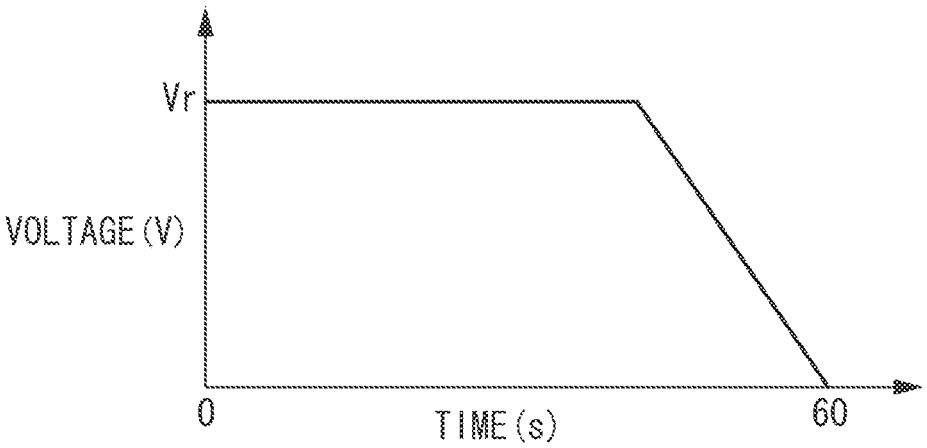
FIGS. 6A and 6B illustrate a time-sequential voltage waveform of the capacitor when the power source cable is disconnected in a power OFF state.

FIG. 6A illustrates a relationship between a time started from a point at which the power source cable 151 is disconnected in the power OFF state and a voltage waveform of the capacitor 304. Since the power consumption is small in the power OFF state, an amount of discharging the electric charge having been charged in the capacitor 304 is small. Therefore, a voltage of the capacitor 304 can be kept for 60 seconds even after the AC input is interrupted.

Figure 6B:
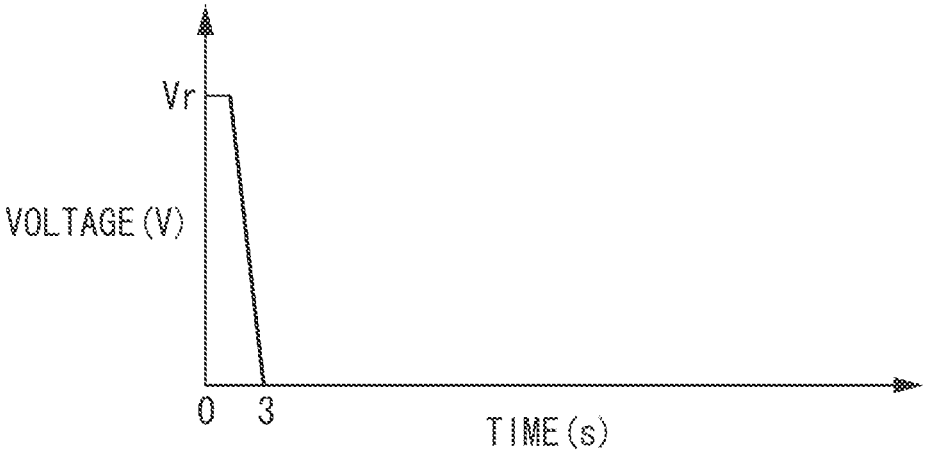

On the other hand, FIG. 6B illustrates a relationship between a time starting from a point at which the power source cable 151 is disconnected when the SW 302 is kept pressed in the power OFF state and a voltage waveform of the capacitor 304. While the SW 302 is pressed in the power OFF state, control of the capacitor discharge is performed, and consumption current increases. As a result thereof, the discharge current of the capacitor 304 becomes larger. A time period during which the voltage of the capacitor 304 is kept becomes 3 seconds, i.e., the discharge of the capacitor 304 can be completed in a short time. As a result thereof, a waiting time of a service person can be remarkably shortened. When the control of the capacitor discharge is completed in a state that the AC input is interrupted, the voltage held by the capacitor 304 and the voltage of the all-night power source become 0 V, respectively, as well as the CPU 306 is turned OFF.

Further in the control of the capacitor discharge, the LED 311 that is supplied with power from the all-night power source is lighted while the capacitor 304 connected to the all-night power source maintains its voltage. When the power source cable 151 is disconnected and the discharge of the capacitor 304 is completed, the voltage of the all-night power source becomes 0 V and thus the LED 311 is turned off. Therefore, for example, when an operator such as the service person performs the control of the capacitor discharge, the service person can visually confirm the completion of the discharge of the capacitor 304.

In the present exemplary embodiment, when the control of the capacitor discharge is performed, a single switching unit is controlled, however the present invention is not limited thereto. The number of switching units connected to the all-night power source may be plural. In addition, the LED of the power source switch is lighted while the control of the capacitor discharge is performed in order to allow the operator to confirm the completion of the discharge of the capacitor 304. However, the present invention is not limited thereto. Another display unit such as the other LED and a liquid crystal may be used so as to allow the operator to visually confirm the discharge of the capacitor 304. Alternatively, the all-night power source may be connected to a speaker as a load to output sound.

As described above, according to the present exemplary embodiment, provided is the printer that has a usability and consumes lower power and that can promptly discharge electric charge of the capacitor while saving a cost thereof. More specifically, by causing the CPU 306 to determine the power supply state of the printer, the switch for conventionally performing the test print when the power is ON is used as a switch for performing the control of the capacitor discharge in the power OFF state. Further in the control of the capacitor discharge, connection to the existing load enables the discharge of the capacitor without requiring an additional circuit. Accordingly, the substrate can be securely prevented from being destroyed by the hot swap.

Since an operator performs the control of the capacitor discharge by operating the switch, discharge of the capacitor connected to the all-night power source can be performed at any time the operator desires. Lighting of the LED such as a power source switch LED that can be visually confirmed by the operator while performing the control of the capacitor discharge enables the operator to confirm the completion of the discharge of the capacitor 304. Accordingly, the substrate can be securely prevented from being destroyed by the hot swap.

An image forming apparatus according to a second exemplary embodiment is described below. The discharge of the capacitor is performed while the SW 302 is kept pressed in the first exemplary embodiment, whereas the discharge of the capacitor is performed for a predetermined time period when the pressing of the SW 302 is detected in the present exemplary embodiment. A description is made as to such control that information is provided by the LED in a case where the discharge is not completed even if the discharge of the capacitor 304 is performed for the predetermined time period. The configurations illustrated in FIG. 1 (i.e., schematic diagram of the configuration), FIG. 2 (i.e., block diagram of the circuit), FIG. 3 (i.e., circuit configuration of the engine controller, the printer controller, and the power unit), and FIGS. 6A and 6B (i.e., relationships between a voltage held by the capacitor and time thereof) according to the present exemplary embodiment are similar to those of the first exemplary embodiment, so that descriptions thereof are omitted here.

Figure 7:
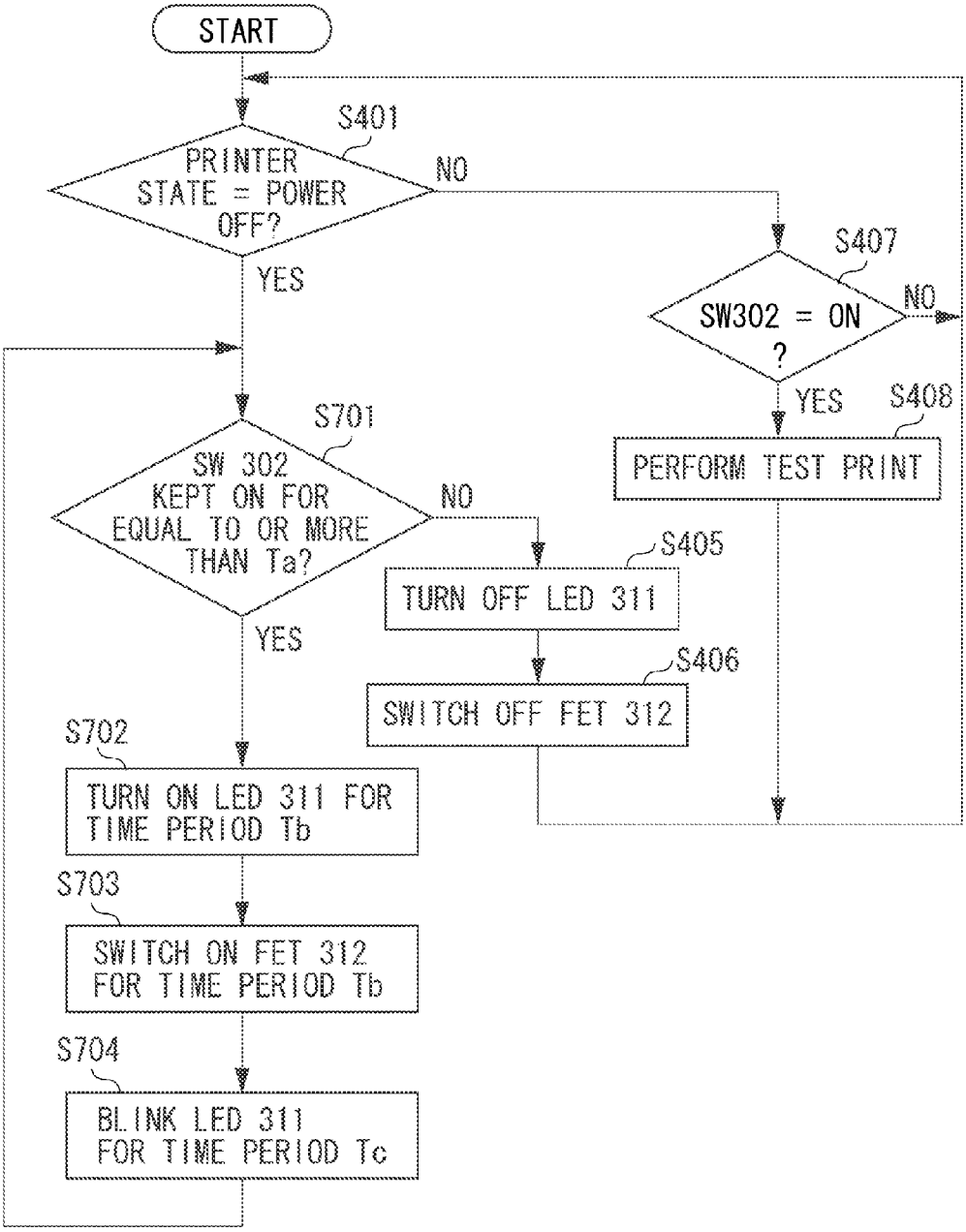
FIG. 7 is another flow chart of the control of the capacitor discharge.

FIG. 7 is a flow chart illustrating control of the capacitor discharge according to the present exemplary embodiment. Processing different from that in FIG. 4 is mainly described here. The flow chart in FIG. 7 is also performed when the printer is placed in a print standby state. Thus, power to be required in forming a toner image is not supplied to members, e.g., fixing device 111, directly related to a toner image formation. To the contrary, the load connected to the power source in the flow chart of FIG. 7 is a load to which power is supplied even when the printer is placed in the print standby state.

In step S401, the CPU 306 determines whether the printer is currently in the power ON state or in the power OFF state. If the CPU 306 determines that the printer is in the power OFF state (YES in step S401), in step S701, the CPU 306 detects whether the SW 302 is pressed for a time period equal to or more than a time Ta.

When the CPU 306 detects that the SW 302 is pressed for the time period equal to or more than the time Ta (YES in step S701), in step S702, the CPU 306 turns the Tr 309 (i.e., switching unit) ON to cause the LED 311 (i.e., load) to be lighted for a period of a time Tb. In step S703, the CPU 306 turns the FET 312 (i.e., switching unit) ON for a period of the time Tb to connect the sensor 206 (i.e., load). A time period during which the Tr 309 and the FET 321 are continuously kept ON is equal to or more than a time period during which at least the discharge of the capacitor 304 is completed under a condition that the AC input voltage from the commercial power supply (i.e., commercial alternating power supply) 150 is interrupted.

In step S704, the Tr 309 is turned ON and OFF to cause the LED 311 to blink for a time period Tc after the time Tb has passed. According to the processing in step S704, the LED 311 can be displayed in a display form different from the display form of the LED 311 (i.e., display unit) corresponding to that in step S703. Accordingly, a failure in disconnecting the power source cable 151 can be informed to the operator.

Figure 8:
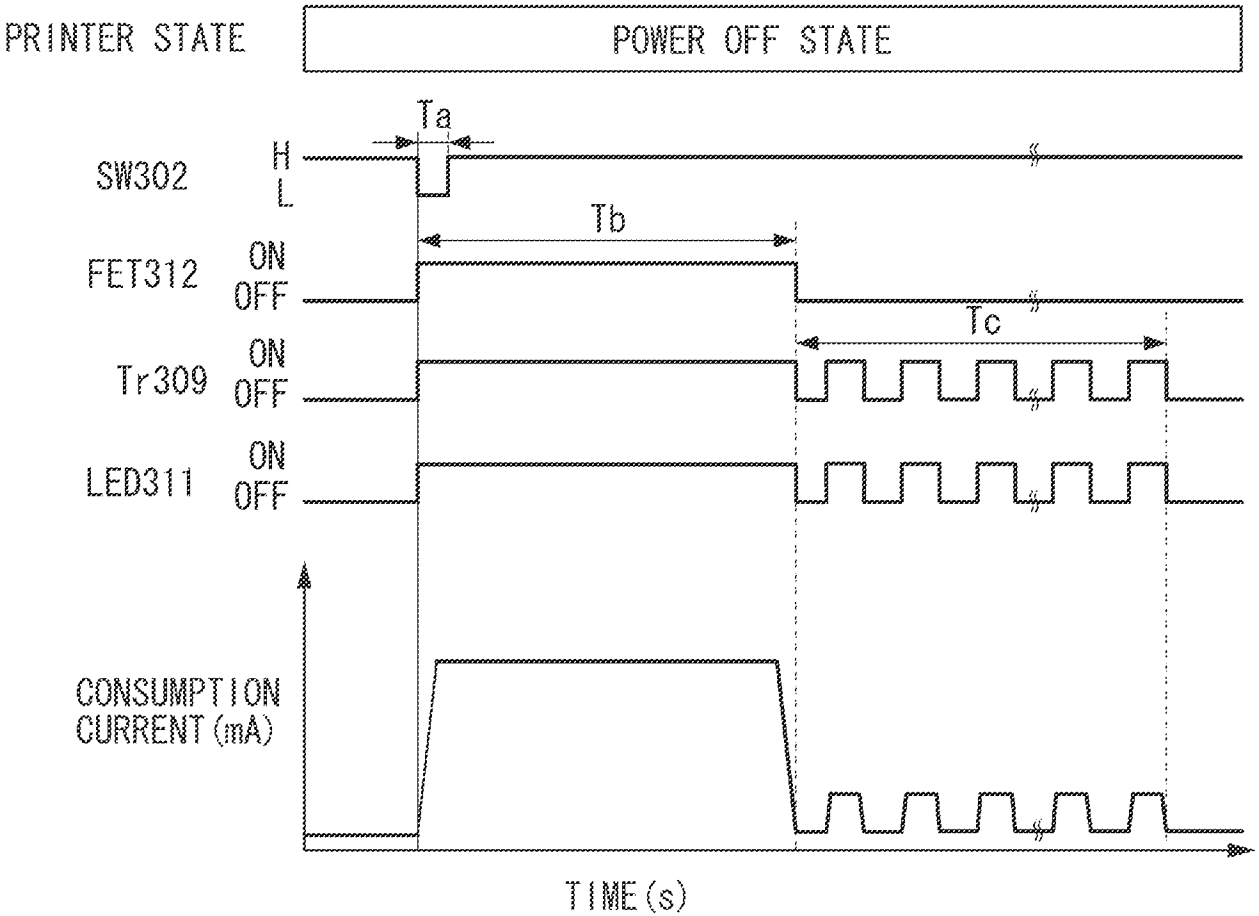
FIG. 8 is another timing chart in the control of the capacitor discharge.

FIG. 8 is a timing chart illustrating the control of the capacitor discharge in the present exemplary embodiment. The time period Ta in FIG. 8 is a time period that the CPU 306 requires in detecting the SW 302 being pressed. The time period Tb is set to be a time long enough for discharging the electric charge of the capacitor when the control of the capacitor discharge is performed after the AC input is interrupted and is to be longer than the time period Ta. The time period Tc is set to 10 seconds.

If the CPU 306 detects that the SW 302 is pressed and that the printer is in the power OFF state, the CPU 306 performs the following control of the capacitor discharge. When the CPU 306 detects that the input signal from the SW 302 changes from High level to Low level and that a time period during which the Low level continues is equal to or more than the time period Ta, the CPU 306 turns the FET 312 ON for the time period Tb as a predetermined time period. The CPU 306 further turns the Tr 309 ON and also causes the LED 311 to be lighted for the time period Tb. After the time period Tb has passed, the CPU 306 causes the Tr 309 and the LED 311 to blink for the time period Tc.

According to the above described control, the operator can end the discharge control of the capacitor with a single pressing of the SW 302, i.e., can save a step of continuously pressing the SW 302. The time period Tb is the time long enough for discharging the electric charge of the capacitor. In addition, the SW 302 can be used as an informing unit for informing that the AC input is performed when the power source cable 151 is failed to be disconnected by causing the LED 311 to blink after the time period Tb has passed.

As described above, according to the present invention, the operator can end the control of the capacitor discharge with a single pressing of the SW 302. In other words, the operator can save the time and effort to continuously press the SW 302. As a result thereof, the substrate can be securely prevented from being destroyed by the hot swap.

In addition, by blinking the LED 311 after the control of the capacitor discharge is performed, the operator can be notified of the failure in disconnecting the power source cable 151 if the power source cable 151 is failed to be disconnected.

An image forming apparatus according to a third exemplary embodiment is described below. In the present exemplary embodiment, a method in which an operating unit and a display unit different from those used in the first exemplary embodiment and the second exemplary embodiment are used is described. The configurations illustrated in FIG. 1 (i.e., schematic diagram of the configuration) and FIGS. 6A and 6B (i.e., relationships between a voltage held by the capacitor and time thereof) according to the present exemplary embodiment are similar to those of the first exemplary embodiment, so that descriptions thereof are omitted here.

Figure 9:
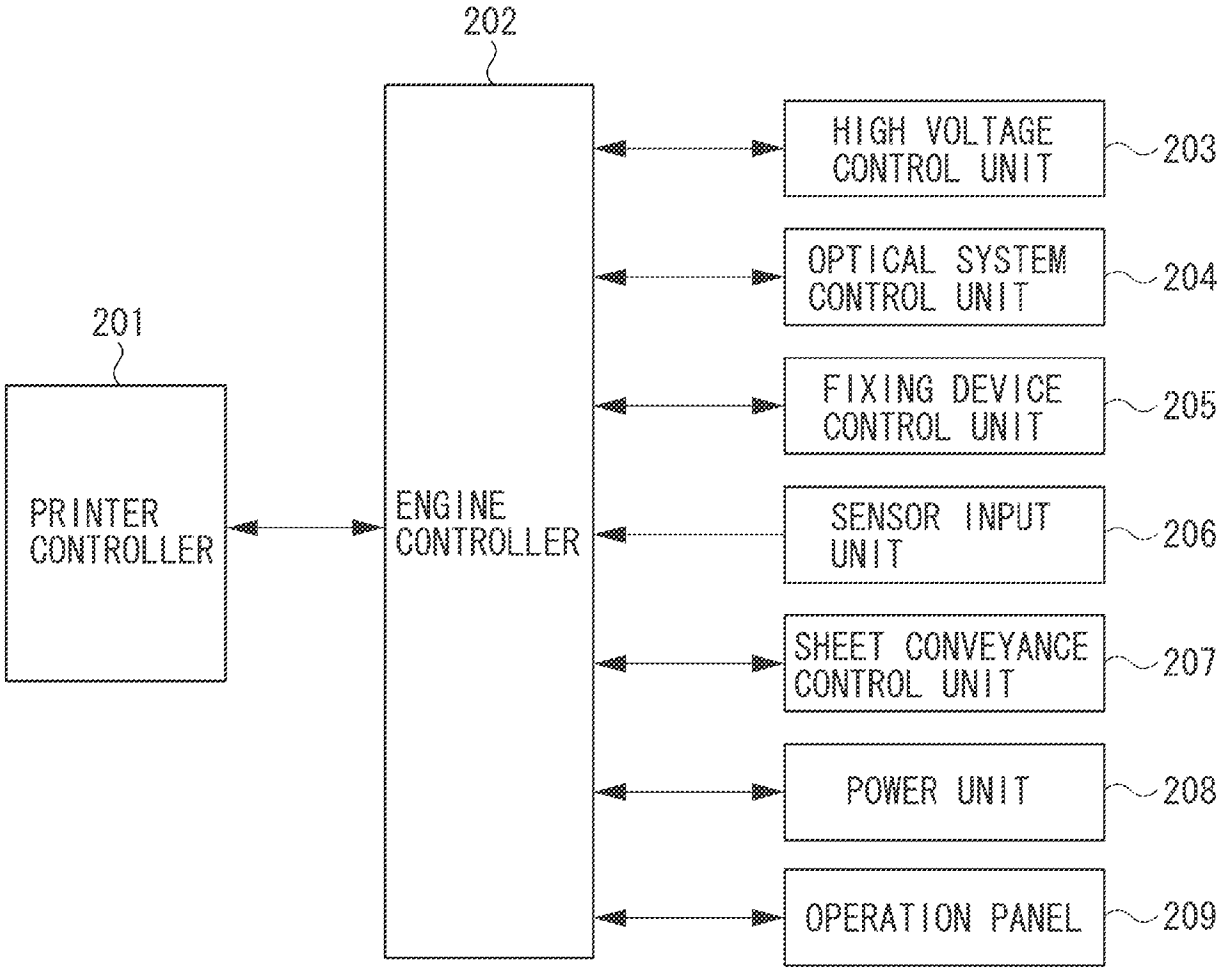
FIG. 9 is a block diagram illustrating a circuit configuration in another image forming apparatus.

FIG. 9 is a block diagram illustrating a circuit configuration in the image forming apparatus 100. An operation panel 209 is newly added thereto. Configurations other than the operation panel 209 are similar to those of the first exemplary embodiment, so that descriptions thereof are omitted here. The operation panel 209 includes a liquid crystal display, various types of switches, LEDs, and the like and is used for informing a printer state to the user, changing various printer settings via a user operation, and the like.

Figure 10:
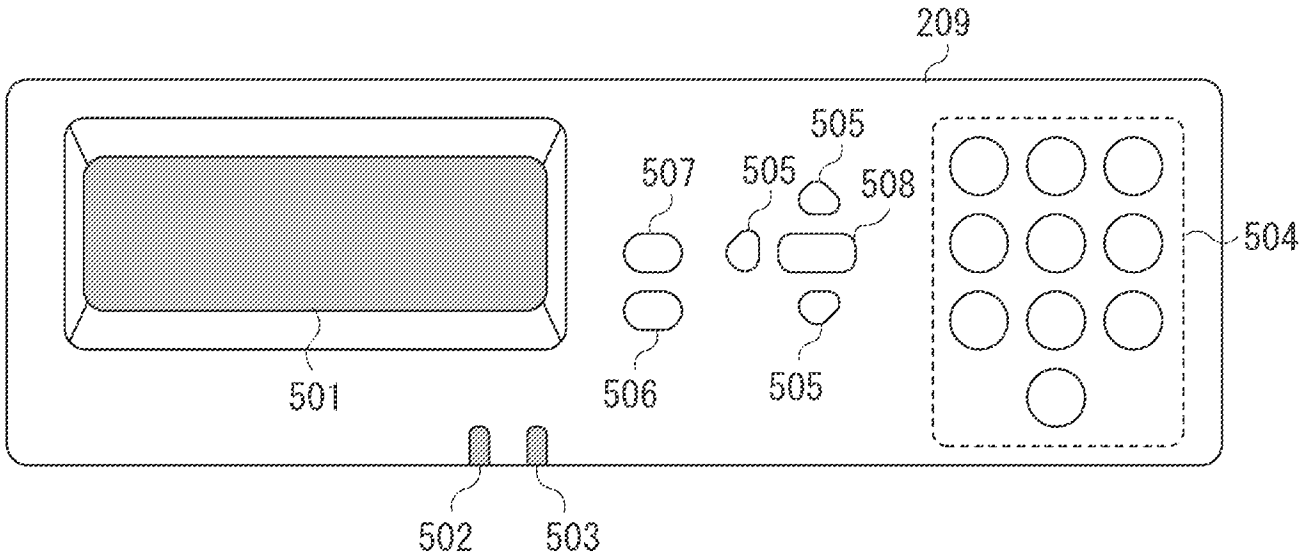
FIG. 10 is a schematic diagram of an operation panel.

FIG. 10 is a schematic diagram illustrating the operation panel 209 according to the present exemplary embodiment. Although an operation button corresponding to the SW 303 described in the first exemplary embodiment is not illustrated in the operation panel 209 in FIG. 10, an operation button corresponding to the SW 303 is actually provided thereon. A momentary switch corresponding to the SW 303 is provided in a power supply circuit diagram in FIG. 11.

The operation panel 209 includes a liquid crystal display 501 as a display unit, LEDs 502 and 503 (i.e., loads), and key switches 504 through 508 (i.e., operating unit for performing an operation other than the ON/OFF operation of the power source). The liquid crystal display 501, the LEDs 502 and 503, and the key switches 504 through 508 are controlled by the CPU 306, respectively. The key switches 504 through 508 are momentary switches. Pressing of each key switch causes the electrodes within the switch to contact with each other to allow energization therebetween only while the switch is pressed, whereas causes the electrodes within the switch to detach from each other to keep non-energization state when the pressing of the switch is stopped.

The liquid crystal display 501 on which graphics indicating character information and apparatus conditions can be displayed can display the apparatus conditions, remaining amounts of consumables, and various settings. The LEDs 502 and 503 can indicate an operating state of the printer to the user by being lighted, turned off, or blinked.

The LED 502 is a Ready LED 502 that lights for indicating a state that the laser beam printer (LBP) is ready for printing, and the LED 503 is an Attention LED 503 that blinks for indicating a state that the LBP is not ready for printing, respectively. The Ready LED 502 blinks while the LBP is in a sleep mode in order to indicate the user that the LBP is in the sleep mode.

The key switch 504 is a numeric keypad for inputting numerals related to various settings. The key switch 505 is a selection key for selecting movement in up, down, and left. The key switch 506 is a stop key for temporarily stopping a printing operation. For example, the stop key 506 is pressed during image formation, a printer controller control unit issues an instruction to stop the printing operation to each unit of the apparatus in operation so as to stop the image formation. The key switch 507 is a menu key for displaying setting menus of the image forming apparatus 100. The key switch 508 is a determination key for entering a selected item.

Figure 11:
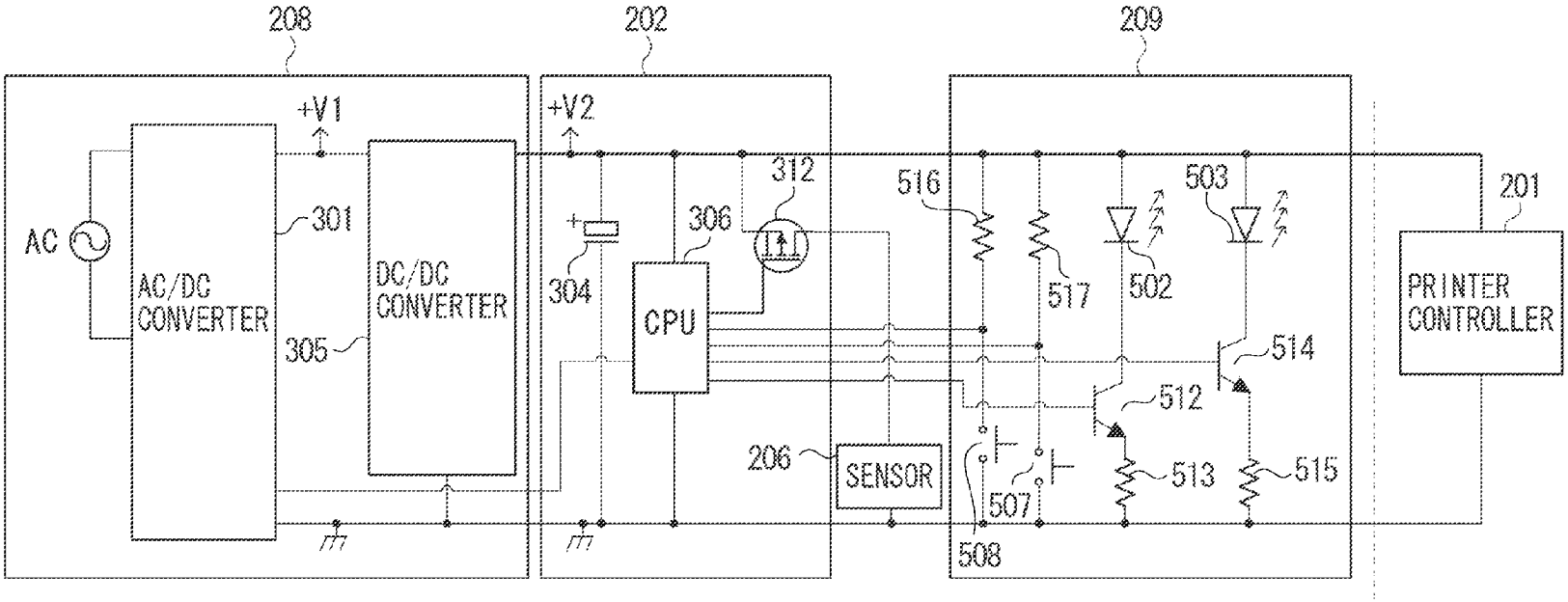
FIG. 11 illustrates a circuit configuration of a power unit.

FIG. 11 illustrates a circuit configuration of the engine controller 202, the printer controller 201, the power unit 208, and the operation panel unit 209 in the image forming apparatus 100. The liquid crystal display 501 and the key switches 504 through 508 (not illustrated in FIG. 11) in the operation panel unit 209 are controlled and detected by the CPU 306, respectively. Current-limiting resistors 516 and 517 of the operation panel unit 209 are resistances for limiting a current flow in a case where the key switches 507 and 508 are pressed, respectively. Turning ON and OFF of the LED 502 (i.e., load) and the LED 503 (i.e., load) is controlled by a Tr 512 (i.e., switching unit) and a Tr 514 (i.e., switching unit), respectively. The other configurations are similar to those of the first exemplary embodiment, so that descriptions thereof are omitted here.

Control of the capacitor discharge in the present exemplary embodiment is described below. In the first exemplary embodiment, a test print button is used to perform the control of the capacitor discharge, whereas, in the present exemplary embodiment, the control of the capacitor discharge is performed according to an operation with the operation panel 209 illustrated in FIG. 10.

Figure 12:
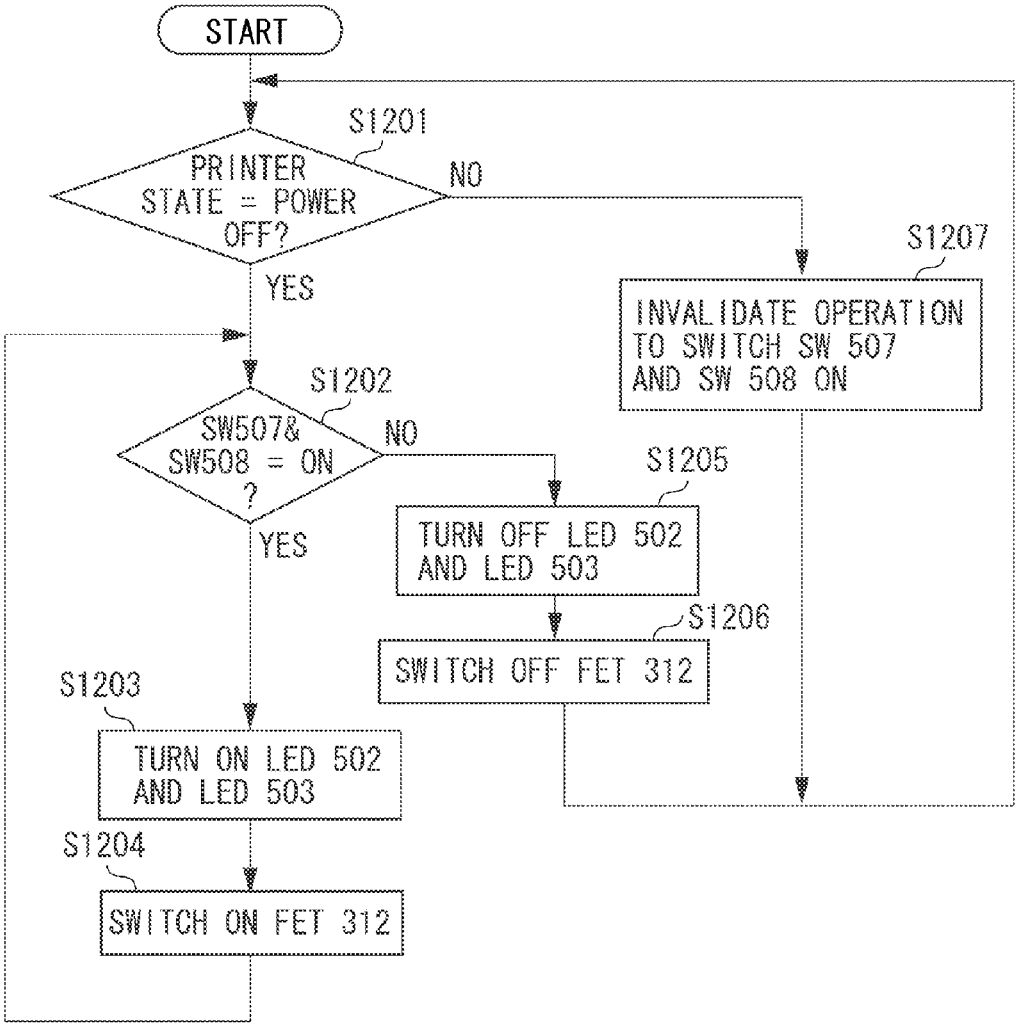
FIG. 12 is further another flow chart of the control of the capacitor discharge.

FIG. 12 is a flow chart illustrating the control of the capacitor discharge in the present exemplary embodiment. In step S1201, the CPU 306 determines whether the printer is currently in the power ON state or in the power OFF state. If the CPU 306 determines that the printer is not in the power OFF state but in the power ON state (NO in step S1201), in step S1207, the CPU 306 invalidates a concurrent operation of the SW 507 and the SW 508. Then, the processing returns to step S1201.

On the other hand, in a case where the CPU 306 determines that the printer is in the power OFF state (YES in step S1201), in step S1202, the CPU 306 detects whether the SW 507 and the SW 508 are concurrently turned ON, i.e., detects a predetermined pressing instruction provided to a plurality of operation buttons.

If the CPU 306 detects that the SW 507 and the SW 508 are concurrently turned ON (YES in step S1202), in step S1203, the CPU 306 turns both of the Tr 512 (i.e., switching unit) and the Tr 514 (i.e., switching unit) ON to cause the LED 502 (i.e., load) and the LED 503 (i.e., load) to be lighted.

Then in step S1204, the CPU 306 turns the FET 312 (i.e., switching unit) ON to connect the sensor 206 (i.e., load) to the power source.

If the CPU 306 detects that either one or both of the SW 507 and the SW 508 is/are turned OFF (NO in step S1202), in step S1205, the CPU 306 turns the Tr 512 and the Tr 514 OFF to cause the LED 502 and the LED 503 to be turned off. In step S1206, the CPU 306 turns the FET 312 OFF to cut off the connection of the sensor 206. Then, the processing returns to step S1201. When the CPU 306 detects that either one or both of the SW 507 and the SW 508 is/are in the OFF state (NO in step S1202), and if the LED 502 and the LED 503 have already been turned off and the FET 312 is in the OFF state, the CPU 306 maintains the state as it is. Then, the processing returns to step S1201.

Figure 13:
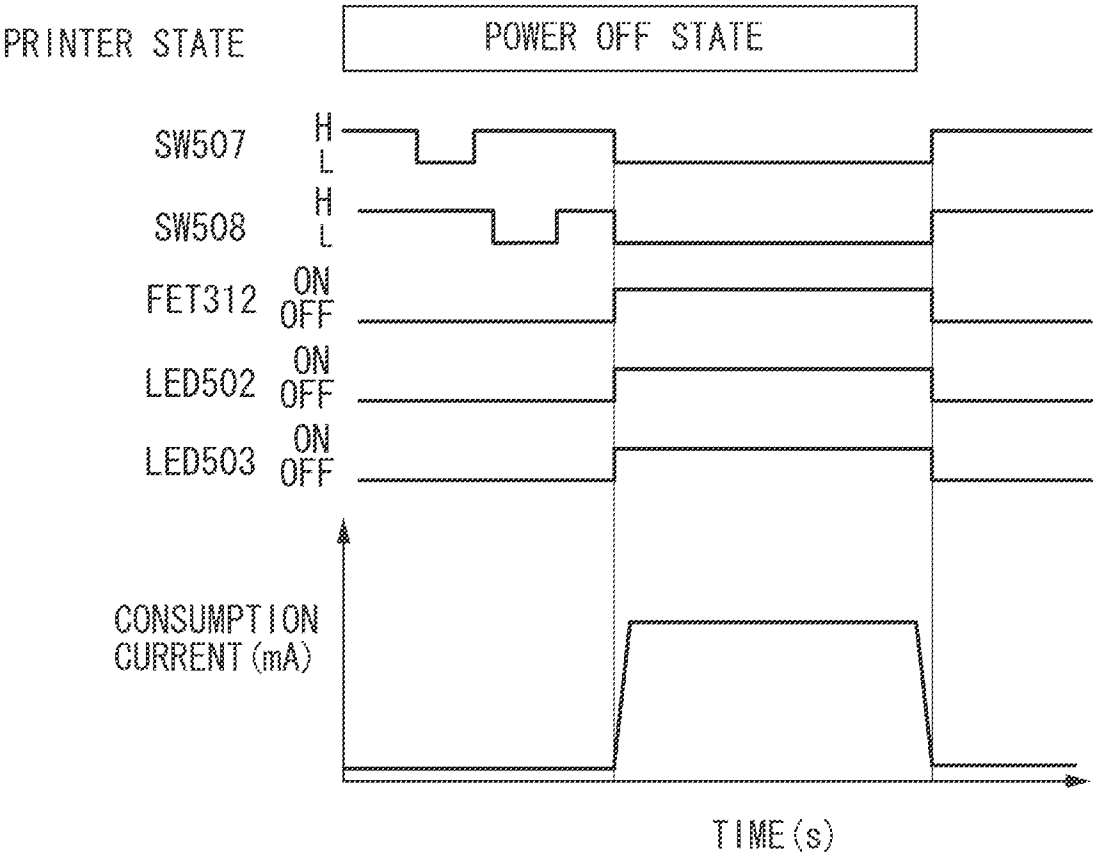
FIG. 13 is further another timing chart in the control of the capacitor discharge.

FIG. 13 illustrates a timing chart in the control of the capacitor discharge in the present exemplary embodiment. The CPU 306 keeps operating regardless of the power OFF state or the power ON state of the printer, so that the CPU 306 can determine whether the printer is in the power OFF state or in the power ON state. When the CPU 306 detects that both of the SW 507 and the SW 508 are concurrently pressed and that the printer is in the power OFF state, the CPU 306 performs the below described control of the capacitor discharge.

When the CPU 306 detects that input signals from both of the SW 507 and the SW 508 are Low level, the CPU 306 turns the FET 312 ON. Further, the CPU 306 turns both of the Tr 512 and the Tr 514 ON to cause the LED 502 and the LED 503 to be lighted. In a case where the printer is in the power OFF state and either one of the SW 507 or the SW 508 is pressed, the CPU 306 does not perform the control of the capacitor discharge.

The test print button according to the first exemplary embodiment is often provided on a portion where a user cannot press with his/her finger and therefore a dedicated tool for pressing the test print button is sometimes required. However, the above described control eliminates the necessity of the dedicated tool and thus improves the user friendliness. In addition, the capacitor discharge is performed only when the user presses a plurality of key switches, at the same time, which are not generally operated by the user, so that the control of the capacitor discharge is seldom performed by the user. Accordingly, unnecessary increase of power consumption can be avoided.

In the present exemplary embodiment, concurrent pressing of two key switches on the operation panel causes the control of the capacitor discharge to be performed. However, the present invention is not limited to this configuration. Alternatively, pressing of a single key switch or concurrent pressing of more than two key switches on the operation panel may cause the control of the capacitor discharge to be performed.

As described above, according to the present invention, when the operator desires to perform the control of the capacitor discharge, the operator can complete the discharge of the capacitor without requiring the dedicated tool.

In the above described exemplary embodiments, the image forming apparatus is exemplified. However, the configurations and the operations of the above described exemplary embodiments are applicable not only to the image forming apparatus but also to any apparatus including the capacitor that smoothen the output from the power source.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-132533 filed Jun. 14, 2011, which is hereby incorporated by reference herein in its entirety.

What is claimed is:

1. An image forming apparatus comprising:

a power source configured to convert an input alternating current (AC) voltage to a direct current (DC) voltage;

a capacitor connected to a voltage output side of the power source;

an operating unit configured to instruct the image forming apparatus to perform a predetermined operation;

a switch configured to switch a state between a state in which the power source is connected to a load and a state in which the power source is disconnected from the load; and a control unit configured to detect an operation of the operating unit, wherein a power supply state to the image forming apparatus can be switched between a first power supply state in which power from the power source is supplied to the control unit and the power source is connected to the load, and a second power supply state in which power consumption is less than that in the first power supply state, the power source is disconnected from the load by the switch to stop supplying power to the load, and the power from the power source is supplied to the control unit, and wherein, when the image forming apparatus operates in the first power supply state, if the operation is detected by the control unit, a predetermined processing according to the detected operation is performed and, when the image forming apparatus operates in the second power supply state, if the operation is detected by the control unit, a state is switched, by the switch, to the state in which the power source is connected to the load without the predetermined processing being performed so as to increase a discharge current of the capacitor.

2. The image forming apparatus according to claim 1, wherein, in the second power supply state, the switch switches a state to the state in which the power source is connected to the load while the operating unit is operated.

3. The image forming apparatus according to claim 1, wherein, in the second power supply state, if the control unit detects an operation of the operating unit, the switch switches a state to the state that the power source is connected to the load for a predetermined time period, wherein the predetermined time period is a time period equal to or more than a time period required for completing discharge of the capacitor in a state that the AC voltage is interrupted.

4. The image forming apparatus according to claim 3, wherein the load is a display unit, and wherein, in the second power supply state, if the control unit detects the operation, the switch switches a state from the state in which that the power source is connected to the load to a state that the power source is connected to the display unit for the predetermined time period.

5. The image forming apparatus according to claim 1, wherein the predetermined processing is a test image forming operation.

6. A discharge device that is configured to discharge a capacitor for smoothing an output from the power source, the discharge device comprising:

an operating unit configured to instruct an operation different from an ON and OFF operation of the power source;

a switch configured to switch a state between a state in which the power source is connected to a load and a state in which the power source is disconnected from the load; and a control unit configured to detect an operation of the operating unit, wherein a power supply state to the discharge device can be switched between a first power supply state in which power from the power source is supplied to the control unit and the power source is connected to the load, and a second power supply state in which power consumption is less than that in the first power supply state, the power source is disconnected from the load by the switch to stop supplying power to the load, and the power from the power source is supplied to the control unit, and wherein, when the discharge device operates in the first power supply state, if the operation is detected by the control unit, a predetermined processing according to the detected operation is performed and, when the discharge device operates in the second power supply state, if the operation is detected by the control unit, a state is switched, by the switch, to the state in which the power source is connected to the load without the predetermined processing being performed so as to increase a discharge current of the capacitor.

7. The discharge device according to claim 6, wherein, in the second power supply state, the switch switches a state to the state in which the power source is connected to the load while the operating unit is operated.

8. The discharge device according to claim 6, wherein, in the second power supply state, if the control unit detects an operation of the operating unit, the switch switches a state to the state that the power source is connected to the load for a predetermined time period, wherein the predetermined time period is a time period equal to or more than a time period required for completing discharge of the capacitor in a state that the AC voltage is interrupted.

9. The discharge device according to claim 8, wherein the load is a display unit, and wherein, in the second power supply state, if the control unit detects the operation, the switch switches a state from the state that the power source is connected to the load to a state that the power source is connected to the display unit for the predetermined time period.

10. The discharge device according to claim 6, wherein the predetermined processing is a test operation.

* * * * *